United States Patent [19]

Patterson

[11] Patent Number: 4,583,516

[45] Date of Patent: Apr. 22, 1986

[54] FIREPLACE INSERT

[76] Inventor: Tommy W. Patterson, P.O. Box 65, Hayesville, Ohio 44838

[21] Appl. No.: 356,124

[22] Filed: Mar. 8, 1982

Related U.S. Application Data

[63] Continuation-in-part of Ser. No. 121,815, Feb. 15, 1980, abandoned.

[51] Int. Cl.[4] ..... F24B 7/00

[52] U.S. Cl. ..... 126/121

[58] Field of Search ..... 126/60, 121, 122, 123, 126/138, 142

[56] References Cited

U.S. PATENT DOCUMENTS

| | | | |
|---|---|---|---|
| 2,642,859 | 6/1953 | Brown | 126/121 |
| 4,092,976 | 6/1978 | Buckner | 126/63 |
| 4,177,793 | 12/1979 | Johnson | 126/121 |
| 4,240,403 | 12/1980 | Bader | 126/193 |
| 4,267,817 | 5/1981 | Hicks et al. | 126/60 |

FOREIGN PATENT DOCUMENTS

| | | | |
|---|---|---|---|
| 849302 | 9/1960 | United Kingdom | 126/121 |

*Primary Examiner*—Randall L. Green

*Attorney, Agent, or Firm*—Oldham, Oldham & Weber

[57] ABSTRACT

The invention relates to a fireplace insert having unique characteristics of a fiberglass insulated twin wall construction engineered to work on the principle of air convection. Cold air is drawn into a bottom inlet, circulated through channels between the firebox and an air shroud or air casing, and forced through outlets at the top of the unit back into the room. A controllable damper cuts down the heat carried up the chimney, and an air tight door controls the amount of in-house air drawn to feed the fire, and hence, the amount of heat that escapes up the chimney.

1 Claim, 5 Drawing Figures

FIREPLACE INSERT

CROSS-REFERENCE

This application is a continuation-in-part of my earlier application bearing U.S. Ser. No. 121,815, filed Feb. 15, 1980, entitled "FIREPLACE INSERT", now abandoned.

BACKGROUND ART

It is now well understood by those skilled in the art that most fireplaces are really uneconomical in that they draw heated air from the home into the fireplace to help affect the combustion of the fire and then forcing a great deal of that already heated air out the chimney. There have been many and various attempts to provide glass fireplace doors, or the like, in order to prevent this discharge, and indeed there further have been many stoves and fireplace inserts developed to likewise combat this problem.

However, these prior art attempts have not provided for a good sealing relationship of the insert with respect to the face of the fireplace or the fireplace housing itself, and hence air still leaks from the house into the fire and up the chimney. Further, when the fireplace is not in use, there can be cold air leaking from around the fireplace insert down through the chimney and affecting adverse energy efficiency in the home.

It is further believed that these prior art fireplace insert approaches have not achieved sufficient insulation of the firebox in combination with air circulation therearound so as to obtain the most effective heat transfer from the firebox and for transmitting such heat back into the room. Further, these prior art attempts have not incorporated a good sealed relationship of the firebox itself by having an airtight door arrangement to prevent air leakage around the door.

DISCLOSURE OF INVENTION

It is the general object of the present invention to avoid and overcome the foregoing and other problems of the prior art practices by providing a fireplace insert that has a firebox performing efficiently as a heat exchanger by utilizing a well insulated air shroud or casing, and air circulation features around the firebox of inside room air to affect the most efficient heat transfer thereto, with the minimum of heat exiting up the chimney. This object is achieved by providing a very efficient arrangement of a large portion of the insert extending on to the fireplace hearth in order to circulate air most efficiently with only slightly over half of the insert extending into the fireplace itself.

A further object of the invention is to provide a unique flared front hood arrangement to achieve an excellent air seal of the fireplace insert against the fireplace face because of the flared hood and the use of thick insulation between the fireplace face and the flared hood.

A further object of the invention is to provide an improved airtight door that prevents heated air from being drawn back into the fire and keep soot, smoke, and sparks from blowing into the room.

A further object of the invention is to provide a specialized baffle arrangement within the air shroud around the firebox to provide for the most efficient flow of air and heat transfer around the firebox, and yet maintain the flared front hood in a cool condition so as to prevent being burned by coming into contact therewith.

A further object of the invention is to provide a fireplace insert which can optionally utilize power blowers conveniently associated with the intake air portion of the flared hood to achieve optimum air flow and heat transfer from the firebox.

The aforesaid objects of the invention and other objects which will become apparent as the detailed description proceeds are achieved by: a fireplace insert for a fireplace having a front face surrounding the fireplace opening thereto which comprises (a) a firebox having a front opening;

(b) an air shroud surrounding the firebox and creating an air space around the sides and top of the firebox;

(c) an exhaust flue at the top back of the firebox and communicating in sealed relationship through the air shroud;

(d) a front hood attached to and communicating with the air shroud and defining a flat surface to engage with the face of the fireplace when the insert is positioned thereinto;

(e) seal means between the hood and the fireplace face to provide a substantial fluid seal between the insert and the fireplace;

(f) means to provide entrance of room air into the base of the hood to circulate around the firebox and discharge back into the room;

(g) baffle means in the air space to direct the major flow of air along the lower sides and to the back of the firebox, and wherein said baffle means has an opening therein adjacent the front of the firebox to direct cool air to the inside portions of the front hood; and (h) a continuous baffle means between the top of the firebox and the top of the shroud of at least one inch spacing from each surface and of substantially the same size as each surface.

BRIEF DESCRIPTION OF DRAWINGS

For a better understanding of the invention, reference should be had to the accompanying drawings, wherein.

BEST MODE FOR CARRYING OUT THE INVENTION

Figure 1:
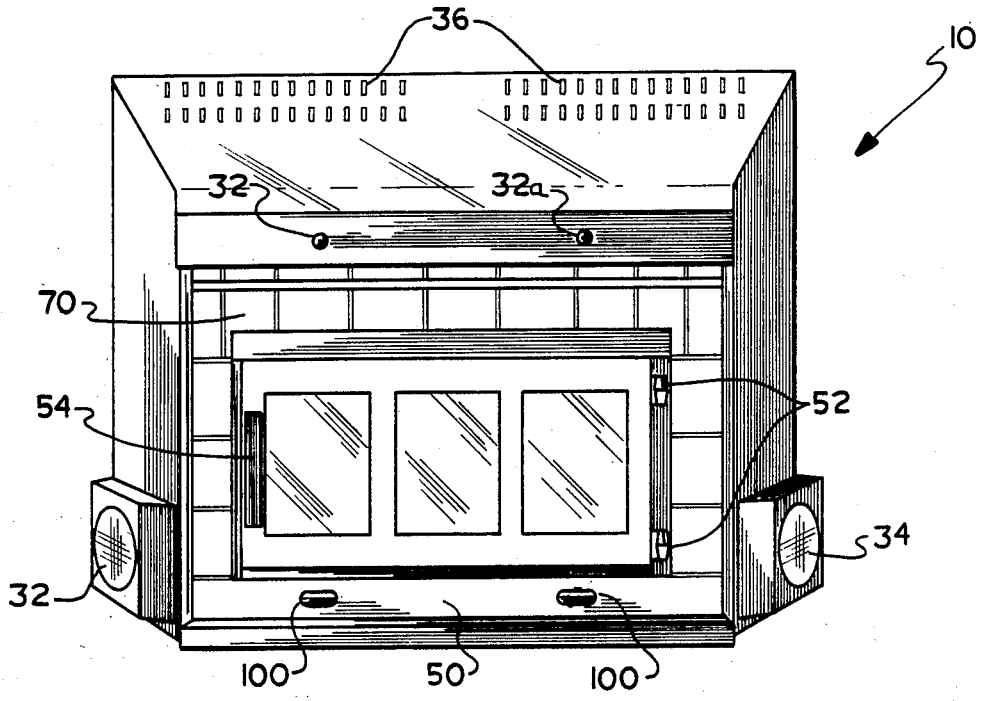
FIG. 1 is a front elevational view of the fireplace insert comprising the preferred embodiment of the invention.
Figure 2:
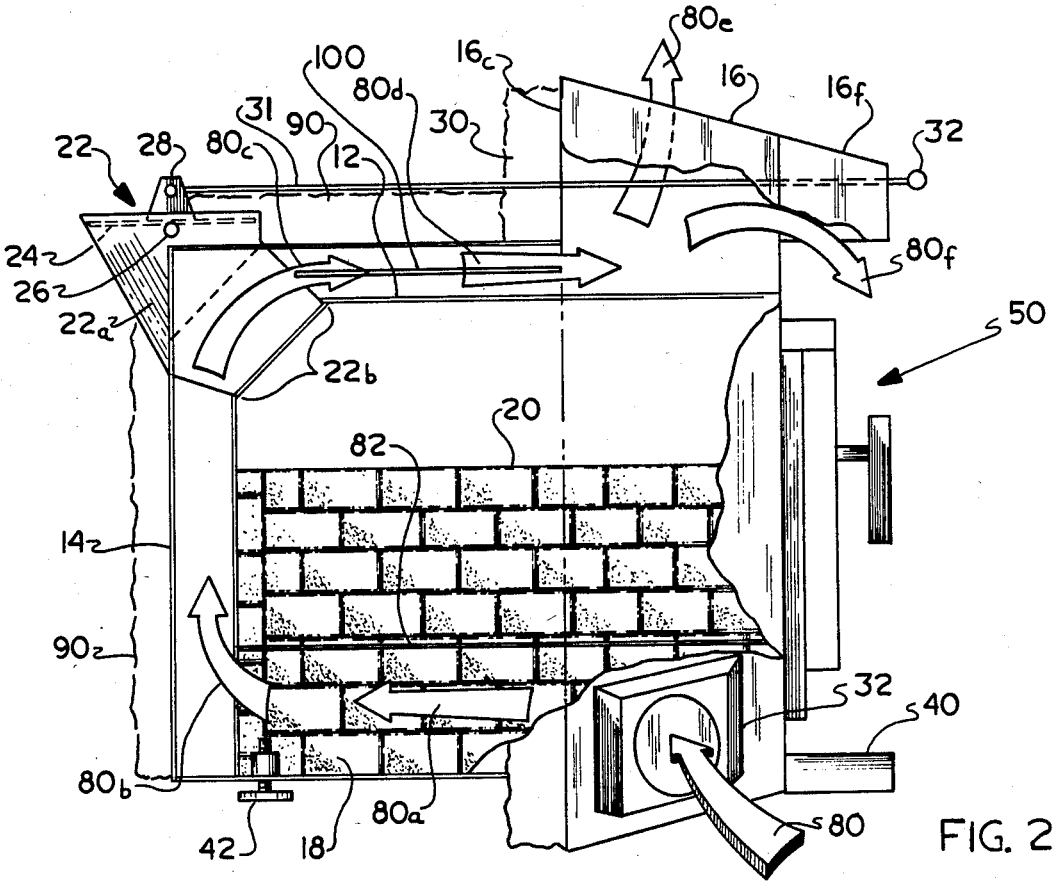
FIG. 2 is a partially broken away side elevational view of the fireplace of FIG. 1.
Figure 3:
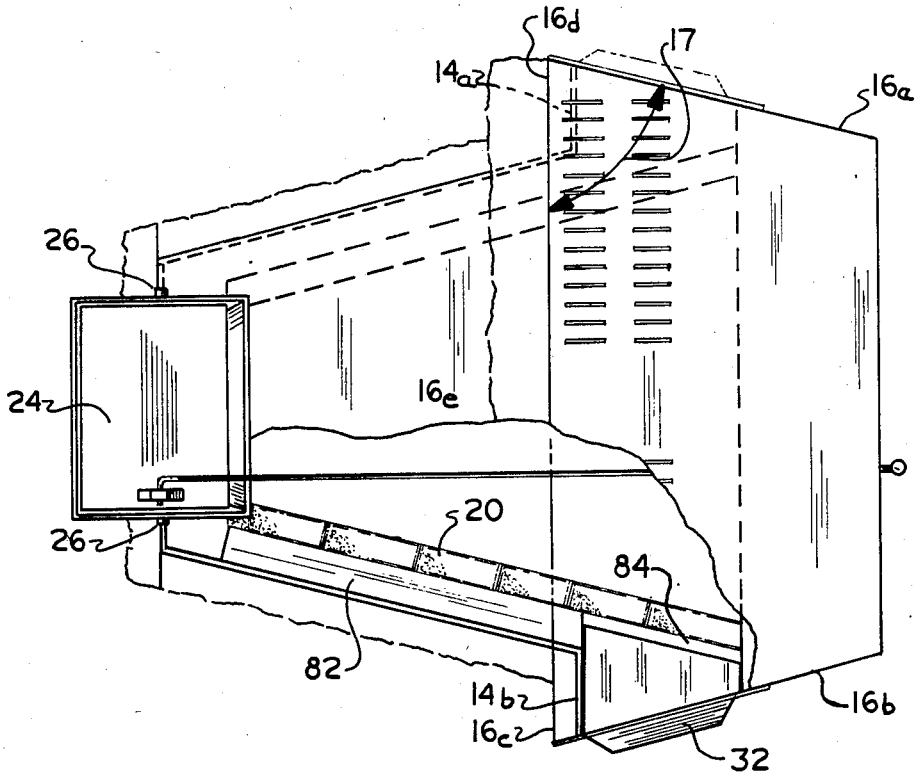
FIG. 3 is a top broken away plan view of the fireplace of FIG. 1.

With reference to the embodiment of the invention, illustrated in FIGS. 1 through 3 of the drawings, the numeral 10 indicates generally a fireplace insert which comprises a firebox identified generally by numeral 12, an air casing or shroud identified generally by numeral 14 surrounding the firebox on all three sides and the top, and a flared front hood indicated by numeral 16 mounted to the shroud 14 and providing the means for input and output air as more fully described hereinafter.

The firebox 12 is preferably made from welded metal pieces, but could be cast, if desired, and includes ceramic fire brick, preferably of about two-inch thickness on the floor, indicated by the numeral 18, and split fire brick of about one and three-eighths inch thickness around the sides and back, indicated by numeral 20. The ceramic fire brick of two inches in the floor is sufficient so that no heat is transferred down through the floor into the base, and hence the shroud 14 surrounds only the sides and the top and thereby operates in an extremely efficient manner in transferring heat generated from within the firebox, as defined hereinafter.

A feature of the invention is the damper indicated generally by numeral 22 which has a direct and sealed communication to the top rear of the firebox through a substantially rectangularly shaped opening as seen best in FIG. 3 of the drawings. The damper plate 24 is pivotally mounted on pins 26 so as to be actuated in pivotal movement by lever arm 28 fixedly mounted to one side thereof and pivotally receiving rod 30 which is connected through the front of shroud 16 to an actuating knob 32 so that a simple straightforward push or pull of knob 32 will cause pivotal action of the damper plate 24 around pins 26 to effectively open or close the damper. It has been found that it is most efficient to operate the fireplace insert with the damper very nearly closed so that only about four square inches of damper area, as opposed to a normal approximate 110 square inches of damper in a standard thirty-six inch fireplace, will be capable of allowing approximately 40 pounds of hard wood to completely burn up over an eight-hour period, providing a heat output of 38,850 BTU at this reduced four-square inch damper opening position. As indicated above, the damper housing identified by numeral **22*a* is connected in sealed relationship at 22*b* to the firebox 12, and likewise passes in sealed relationship through the shroud 14** so as to provide a direct and sealed communication from the firebox through the damper, and hence into the chimney when the fireplace insert is appropriately positioned into the fireplace for use as will be described hereinafter.

A further important feature of the invention is in the flared front hood 16 wherein, as best seen in the top plan view of FIG. 3, the sides of the front hood extend at approximately a 62° angle towards each other, indicated by numeral 17, to create a very pleasing aesthetic appearance in the room, as well as providing larger side face surfaces **16*a* and 16*b*, which achieve a larger surface area to effect heat transfer, and also to attain a cooled relationship on these surfaces, thus enhancing the safety feature of the insert to prevent burning of any one or anything coming into contact with these surfaces 16*a* and 16*b* during the use of the fireplace insert. The flaring of face surfaces 16*a* and 16*b* also then results in large flat side surfaces 16*c, d,* and *e,* on the side and top portions outside the shroud 14, all as best seen in FIG. 3. These flat surfaces 16*c, d,* and *e,* cooperate with a recessed relationship of the shroud 14 at the sides, as indicated at 14*a* and 14*b* in FIG. 3 so that the fiberglass type insulation 30 can be inserted into the recess provided thereby and stay in position to allow a compressed fluid seal when the fireplace insert is positioned into the fireplace. The same recessed relationship is provided along the top edge of the shroud 16 to receive the fiberglass seal strip as is shown on the sides 14*a* and 14*b* in FIG. 3. Hence, the fiberglass strip 30 extends continuously around the sides and top to form a continuous perimeter between the faces 16*c, d,* and *e,* and the face of the fireplace as the insert 10 is pushed into the fireplace. Preferably, the flared front hood provides that the surfaces 16*c, d,* and *e* will be four to six inches long so that a large flush compressed relationship of the fiberglass 30 is achieved between the face of the fireplace and the recessed relationship defined with the edges 16*c, d* and *e* and the recessed surfaces 14*a* and 14*b* of the shroud. This fluid-sealed relationship of the hood 16 to the fireplace face is extremely important so that no cold air leaks down the fireplace and into the room, and further so that no warm air from the room leaks past the fireplace insert and up the chimney, as it will tend to be drawn by the hot gases leaving the flue 22 when a fire is burning in the firebox 12, and this structural arrangement very effectively achieves this desired result, particularly when the fiberglass material 30 is preferably at least four inches thick and is very compressed as the insert 10** is positioned into the fireplace. The large four to six-inch overhang ensures that the proper seal is achieved even with variable widths and heights of the fireplace opening, and even against irregular brick or stone faces.

A further structural feature of the hood 16 is the provision of the inlet cold air ports indicated generally by numerals 32,34 on the lower sides of the hood. These inlets are provided of such size so as to receive a small electric motor and fan thereinto, hence enhancing the forced circulation of air as desired. The hood 16 has a series of outlet holes indicated generally by numeral 36 along the top edge, and also has a top projection **16*f* extending out to provide a pleasing appearance and further to receive the rod 31** in sliding relationship for support therethrough, which is open, and allows the discharge of hot air being circulated around the firebox in a manner more fully described hereinafter.

The structure of the fireplace insert design is then completed by having a forwardly projecting hearth sill or bottom plate 40, and two support legs 42 in the rear which are vertically adjustable so as to allow the positioning of the fireplace in exactly horizontal relationship after it has been pushed into final position in the fireplace. The legs 42 can be reached by a screwdriver from inside the firebox upon simple removal of a few of the fire brick, and then screwed up or down to obtain the proper horizontal level. Preferably, the hearth sill 40 is about three-eighths inch lower than the bottom of the firebox 12, and hence the legs 42 will have to be adjusted downwardly to obtain the proper horizontal level. Hence, the fireplace insert 10, when fully in position, is supported on the hearth sill 40 along the full front edge and then on the two legs 42 at the rear, normally being fully pushed into position so as to compress the fiberglass as described above around the full perimeter of the hood so as to seal the brick and stone joints normally associated with the face of the fireplace.

Figure 4:
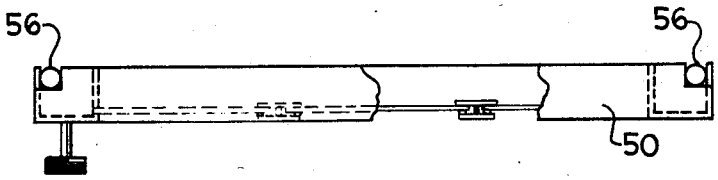
FIG. 4 is a top broken away plan view of the door construction.
Figure 5:
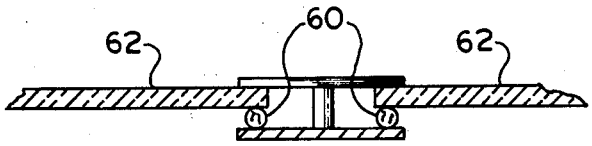
FIG. 5 is an enlarged cross-sectional view of the door construction as taken from line 5—5 of FIG. 4.

The firebox 12, of course, has an opening on the front thereof and a door indicated generally by numeral 50 is provided which is hinged at 52 and has a handle 54 and three glass openings. The door is designed to provide a sealed air-tight relationship with the firebox, and this is provided as best seen in FIGS. 4 and 5, wherein a bead of asbestos braiding 56 extends around the full outside perimeter on the inside surface of the door 50 so that when the door is positioned and the handle latched, there is a pressure seal on the asbestos braid 56 around the full perimeter to obtain a fluid-tight closure. Similarly, as indicated in FIG. 5, asbestos braids 60 are provided around the full perimeter of the glass 67 as held in place by the frame so that there is no leakage around the glass in the door 50, either.

As a decorative feature, the face of the firebox may have colored tiles indicated generally by numeral 70 as best seen in FIG. 1, adhesively secured thereto. A further decorative feature is to add a dummy-brass knob 32*a* at a balanced opposite position from knob 32.

The essential air flow of the invention is depicted primarily in FIG. 2 which indicates input cold air through the opening 32 which preferably will have a grill work of some type thereon, as shown by arrow 80, thence primarily deflected down and along the backsides between the shroud 14 and the firebox 12 as depicted by arrows 80*a* and 80*b*, and achieved by a deflection baffle 82 extending from the opening 32 to deflect the air as indicated. In this connection, an important feature of the invention is that there is a small open space 84 between the structure surrounding the opening 32 and the baffle 82 which allows a small portion of the input air to pass up and along the inside surface of the side portions of hood 16 so as to effect a cooling thereof and prevent any person or thing from being burnt by coming into contact with this portion of the hood.

The air then, by the time it passes at about the position of arrow 80*b*, is directed upwardly along the back of the firebox, around the openings to either side of the damper 22, as indicated by arrow 80*c*, along the top of the firebox at 80*d*, and thence either up and out the openings 36 as indicated by arrow 80*e*, or down and out through the extension 16*f* of hood 16 as indicated by arrow 80*f*. Naturally, because there is a large opening after the air passes beneath baffle 82 as indicated by arrow 80*b* between the firebox 12 and the shroud 14, some air can and will pass along the side walls and up towards the position of arrow 80*d* and 80*e*, without extending clear around the back and up to the position of arrow 80*c*. Thus, it should be clearly understood that all uniform amounts of cold air passing around the fully exposed surface of firebox 12 to effect the most efficient of this air flow will in effect have the desired results of heat transfer from the firebox 12 to the air which is being discharged back into the room at 80*e* and 80*f*.

As a further enhancement to the air heat exchange characteristics of the fireplace insert, it is extremely desirable to include a several inch thick layer of insulation around the fully exposed surface of the air shroud 14, this indicated generally by numeral 90 in FIGS. 2 and 3. Preferably, this will be fiberglass insulation with an outer aluminum facing.

It should be understood that an important feature of the invention is that the portion of the fireplace insert extending into the room is 40 to 50 percent of the total depth of the fireplace, as is evident from viewing FIGS. 2 and 3 of the drawings, thus ensuring a natural air flow input from the room to openings 32, and hence a natural air flow around the firebox because of the larger portion extending into the room. The basic design is for approximately 13½ inches to be the depth extending into the fireplace with 10 inches extending onto the fireplace hearth in order to circulate the air most efficiently.

As best seen in FIG. 1, small controllable opening combustion ports indicated by numeral 100 are included just below the door 50.

The fiberglass insulated twin wall construction hence is engineered to work on the principle of convection with more rapid circulation being achieved by utilizing the dependent electric blowers in the inlets 32 and 34. Hence, the cold air drawn into the bottom inlets 32 and 34 circulates through the channels between the firebox heat exchanger 12 and the air shroud 14 so that warm air is forced through the outlets at the top and front of the hood, or in opposite relationship to the inlets and back into the room.

By appropriately setting the damper, a slow, even burn will be achieved achieving much greater heat efficiency than a regular fireplace, while actually consuming less wood in the same amount of time. Naturally, fireplace type glass is utilized in the door, and the ceiling of the door and the glass relative to the firebox prevents heated air from being drawn back into the fire and keeps soot, smoke, and sparks from blowing into the room.

Another extremely important feature of the invention is the addition of another baffle 100 positioned between the upper surface of the firebox 12 and the top surface of the shroud 14, all as best seen in FIG. 2 of the drawings. This baffle is a continuous baffle and extends across the full width and length between the top surface of the firebox and the shroud as clearly illustrated which, in effect, provides a complete top baffle between the firebox 12 and shroud 14, thus allowing the shroud 14 to be sufficiently cooled so as to be positioned in a zero contact or nearly zero contact relationship to wood or other surface when utilized as a fireplace insert in a zero contact or zero clearance type of fireplace. In other words, the addition of the baffle 100 allows a sufficient cooling on the top shroud 14 so as to be quite readily accessible to hand touch, even with a very hot fire burning in the firebox, and thus adaptable to the zero clearance characteristic. The baffle 100 is preferably placed about midway between the top of the firebox 12 and the shroud 14, but, in any event, I have found that it is extremely important that there be at least a two-inch clearance between the top of the firebox 12 and the top of the shroud 14 so that there is about a one-inch clearance at minimum between the baffle 100 and the firebox and shroud, respectively, on both of the sides thereof. This type of spacing I have found to be extremely important so as to achieve the cooling effect on the shroud 14 desired to achieve the zero clearance characteristic. The baffle 100 is preferably a continuous baffle that is of substantially the same size, in terms of square inches, as the top of the shroud and the top of the firebox so as to provide a complete barrier to the top of the shroud.

Because the fireplace insert is made from heavy metal and utilizes the fire brick on the floor and the sides, it is a heavy unit that will effectively remain in place once positioned simply by gravity, and will provide the seal around the full periphery of the hood as defined above. It should also again be stressed that the hood itself will remain cool, at least relatively so, whereby it will not have enough temperature to burn anybody or anything, even though a large portion of the hood is an exposed relationship in the room.

While in accordance with the patent statutes only the best known embodiment of the invention has been illustrated and described in detail, it is to be particularly understood that the invention is not lifited thereto or thereby, but that the inventive scope is defined in the appended claims.

What is claimed is:

1. A fireplace insert for a fireplace having a front face surrounding the fireplace opening thereto which comprises:

(a) a firebox having a front opening;

(b) an air shroud surrounding the firebox and creating an air space around the sides and top of the firebox;

(c) an exhaust flue at the top back of the firebox and communicating in sealed relationship through the air shroud;

(d) a front hood attached to and communicating with the air shroud and defining a flag surface to engage with the face of the fireplace when the insert is positioned thereinto and having about a 60° angle on its side and top surfaces, converging towards the room to provide a larger exposed hood surface within the room when the fireplace insert is fully in position in the fireplace;

(e) seal means between the hood and the fireplace face to provide a substantial fluid seal between the insert and the fireplace;

(f) means to provide entrance of room air into the base of the hood to circulate around the firebox and discharge back into the room;

(g) baffle means in the air space to direct the major flow of air along the lower sides and to the back of the firebox, and wherein said baffle means has an opening therein adjacent the front of the firebox to direct cool air to the inside portions of the front hood; and (g) a continous baffle means between the top of the firebox and the top of the shroud of at least one inch spacing from each surface and of substantially the same size as each surface.

* * * * *